United States Patent [19]

March

[11] 3,938,630

[45] Feb. 17, 1976

[54] FABRICATED CASE

[75] Inventor: Joseph E. March, Chicago, Ill.

[73] Assignee: Platt Luggage, Inc., Chicago, Ill.

[22] Filed: Feb. 6, 1975

[21] Appl. No.: 547,472

[52] U.S. Cl. ..... 190/24; 190/49; 190/54

[51] Int. Cl.[2] ..... A45C 13/00

[58] Field of Search ..... 190/19, 23, 24, 25, 28, 190/37, 49, 50, 54; 220/DIG. 25, 80

[56] References Cited

UNITED STATES PATENTS

| | | | |
|---|---|---|---|
| 361,885 | 4/1887 | Morrow | 190/24 |
| 800,038 | 9/1905 | White | 190/24 |
| 1,265,212 | 5/1918 | Kleber | 190/24 |

FOREIGN PATENTS OR APPLICATIONS

| | | | |
|---|---|---|---|
| 1,065,758 | 1/1954 | France | 190/54 |

*Primary Examiner*—Donald F. Norton
*Attorney, Agent, or Firm*—Fitch, Even, Tabin & Luedeka

[57] ABSTRACT

A fabricated case is described which is suitable for carrying relatively heavy objects. Two opposed hinged concave shells are shown, each including a back wall and four side walls. In at least one of the shells, at least three of the walls joined by integral corners are formed from a single sheet of semi-rigid material, such as plastic, bent by the use of a heated tool, and joined along an edge of the sheet to a metallic frame section which provides strength and rigidity to the case. In contrast to molded attache or luggage case shells, the shells may be made with greater depth and in diverse shapes without the use of vacuum molds or other special tooling. The preferred frame section is F-shaped in cross section with a channel portion and an integral flange portion extending therefrom and forming a continuation of the base of the channel portion. The flange portion lies against the outer side of the walls with the channel portion extending transversely across the coextensive edge. An elongated clamping member is disposed against the inner side of the walls and is secured to the frame section by suitable fasteners.

11 Claims, 6 Drawing Figures

FABRICATED CASE

This invention relates generally to fabricated cases and, more particularly, to carrying cases of diverse shapes and sizes for carrying various articles including heavy objects.

Luggage cases or attache cases are usually constructed with two hinged concave shells each formed by vacuum or otherwise molding a plastic or a plastic laminate. Generally speaking, such molded shells are unsuited for carrying relatively heavy objects or objects having a considerable depth dimension. This is because the plastic sheet for the shell is stretched during the vacuum molding process and loses strength particularly when the sheet is stretched to provide a deeply drawn shell. Also, molded shell cases require expensive tooling and molding and hence are limited to relatively large production techniques where the higher cost tooling may be offset over a large number of cases. Such molding techniques do not lend themselves to producing small runs of cases of diverse shapes.

While luggage case constructions suitable for carrying relatively heavy objects are known in which molded shells are not utilized, such designs as the so-called "steamer trunk" require a considerable number of parts to inventory and are costly to assemble.

Therefore, a general object of the invention is to provide a new and improved fabricated case.

Another object of the invention is to provide an improved carrying case suitable for carrying relatively heavy objects.

A further object of the invention is to provide a carrying case which may be assembled using only limited tooling or no tooling at all.

Other objects of the invention will become apparent to those skilled in the art from the following description, taken in connection with the accompanying drawings wherein.

Figure 1:
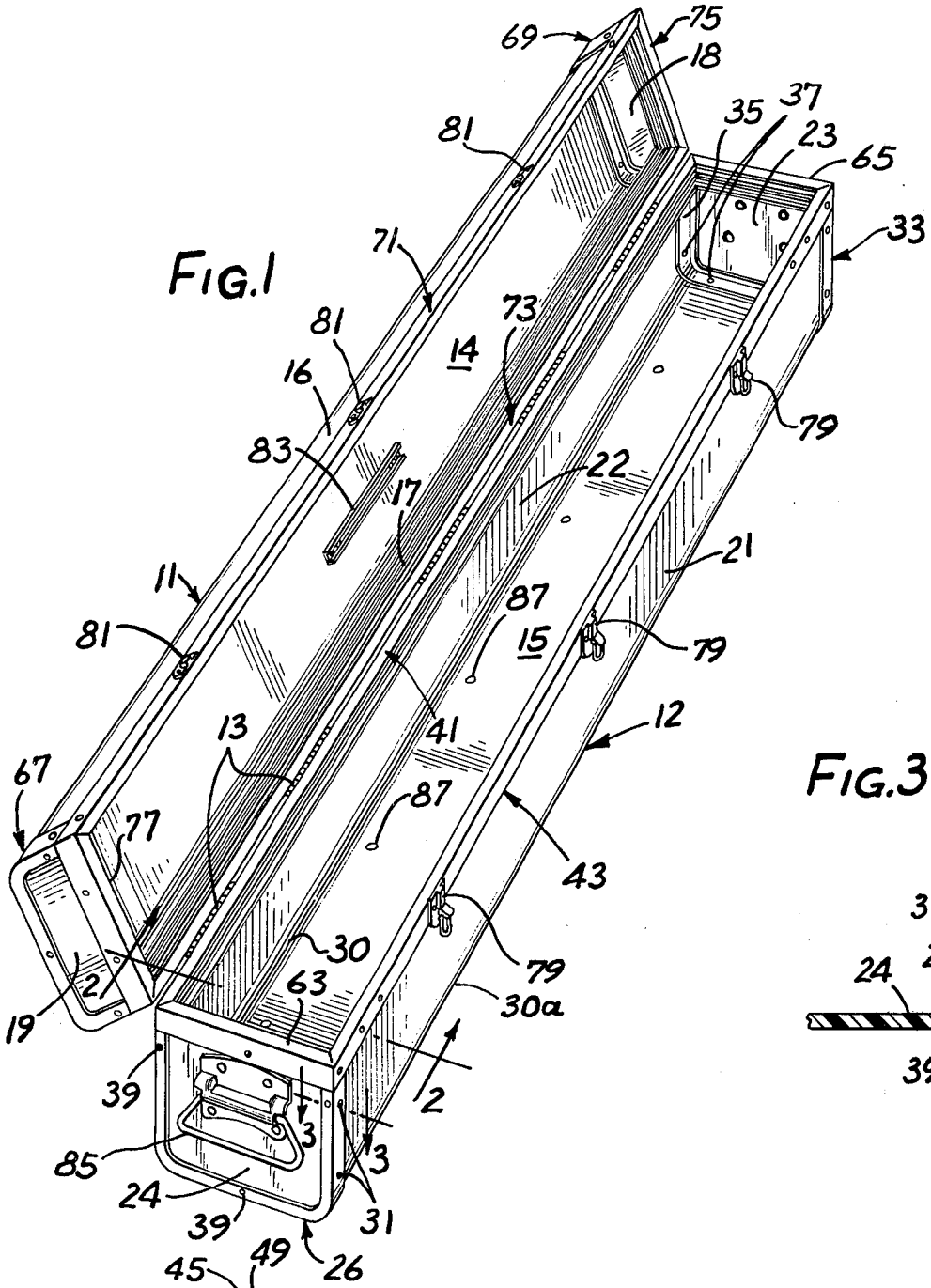
FIG. 1 is a perspective view of a luggage case constructed in accordance with the invention in the open condition.

Very generally, the fabricated case of the invention comprises two opposed concave shells 11 and 12 and means 13 pivotally mounting the shells for movement between a closed position in which the shells enclose a volume to an open position in which the concavities of the shells are exposed. Each of the shells includes a back wall 14 and 15, respectively, and four side walls 16, 17, 18 and 19, and 21, 22, 23 and 24, respectively.

The fabricated cases herein disclosed may be readily constructed with little tooling in diverse shapes and with deep shells in contrast to the usual molded luggage or attache cases which use a vacuum mold to form a molded shell of a specific shape. Molded shells cannot be drawn deeply without a considerable loss in strength due to the stretching of the sheet during vacuum formation of the shell. In many instances, it is desired to construct a deep carrying case for heavy objects and to make only a limited number of cases which would not justify the expense of separate tooling therefor.

In accordance with the present invention, cases may be formed without expensive tooling and with a deep shell 12, if desired, by bending a sheet of semi-rigid material, such as a plastic sheet, to form three side walls 15, 21 and 22 of the shell and by securing at least one continuous edge 25 of the sheet to at least one metal frame section 26 bent to coextensive with the continuous edge 25 of the sheet. The sheet of which the walls 15, 21 and 22 are formed has a continuous edge at each end lying in the plane of all of the walls 15, 21 and 22. One of these edges is visible in the cross section of FIG. 3 and is indicated at 25. The edge 25 follows a generally U-shaped configuration corresponding to the cross section shown in FIG. 2. The metal frame section adds considerable strength and rigidity to the shell and also may be used to secure and retain another wall such as end wall 24. A plurality of frame sections 26, 33 and 41 are used to form the lower shell 12 and to stabilize and add rigidity to the lower shell. Herein, each frame section comprises a channel portion 27 and an integral flange portion 28 extending from the channel portion and forming a continuation of the base of the channel portion. The flange portion is disposed against the outer side of the walls at the continuous edge 25, with the channel portion 27 extending transversely across the continuous edge. An elongated clamping member 29 is coextensive with the frame section 26 and is disposed against the inner side of the walls opposite the flange portion 28. Means 31 attach the clamping member and the flange portion to the walls therebetween.

Figure 3:
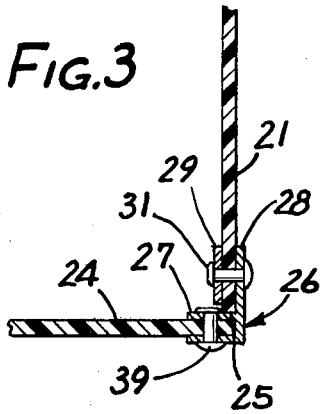
FIG. 3 is a partial sectional view taken along a plane through the line 3—3 of FIG. 1.
Figure 2:
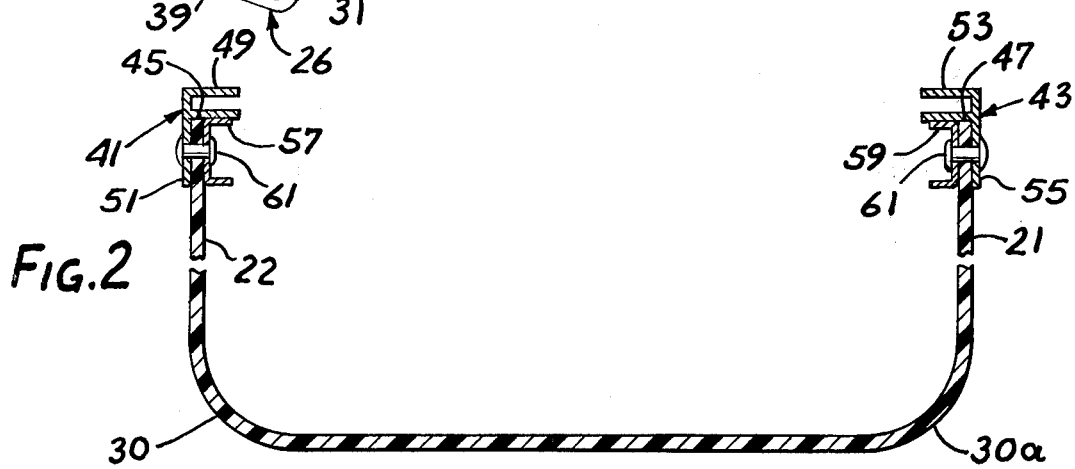
FIG. 2 is a sectional view, partially broken away, taken along a plane through a line 2—2 of FIG. 1.

Referring now in greater detail to FIGS. 1–3, the case illustrated therein is substantially elongated and is designed for carrying relatively heavy elongated objects. More particularly, the case illustrated in FIGS. 1–3 is designed for carrying a laser and may be, for example, of the order of five feet in length and roughly one foot square in cross section. Thus, the lower shell must have considerable depth thereto and, if drawn to this depth by stretching during vacuuming, much of the strength of the sheet would be lost. Suitable structure, not shown, may be provided internally of the illustrated case for the purpose of capturing and protecting the laser carried therein. In the illustrated embodiment, the concave shells 11 and 12 are of different sizes, the former being somewhat smaller in depth than the latter.

The concave shell 12 forms the lower portion of the case illustrated in FIGS. 1–3. The back wall 15 and the opposing contiguous side walls 21 and 22 are formed of a single sheet of semi-rigid material such as ABS plastic. This is shown more clearly in FIG. 2 wherein it is seen that the walls 21 and 22 are formed by bending the sheet upwardly from the plane of the back wall 15. The walls 15, 21 and 22 thereby form an elongated trough of a generally U-shaped cross section. The semi-rigid material may be any suitable material which will provide, with the reinforcing described below, adequate structural soundness, and which may be bent into the form shown without damage and without using special tools such as forming dies. Materials such as polypropylene, polyethylene, and ABS plastic may be bent with suitable heated tools to form curved corners 30 and 30a which give the appearance of a rounded, molded shape and enhance the aesthetic appeal of the case.

For the purpose of providing rigidity and holding the sheet to the desired bent shape, the frame section 26 is coextensive with the continuous edge 25. The frame section 26 is shaped to follow the edge 25 as may be seen in FIG. 1. The frame section 26 may be an extrusion of aluminum or other suitable material and comprises a channel portion 27 and an integral flange portion 28 extending therefrom and forming a continuation of the base of the channel portion. Thus, the general form of the cross section of the preferred frame section 26 is that of a capital F, shown inverted in FIG. 3. The flange portion 28 is disposed against the outer side of the walls 21, 15 and 22 at the continuous edge 25 with the channel portion 27 extending transversely across the continuous edge.

In order to secure the walls 21, 15 and 22 to the frame section 26 tightly, without tearing of the fasteners through the plastic sheet walls, an elongated clamping member 29 is utilized coextensive with the frame section 26 and disposed against the inner side of the walls 21, 15 and 22 opposite the flange portion 28 and rivets 31 connect the frame section 26 to the clamping member. In the illustrated embodiment, the elongated clamping member 29 comprises a flat strip of a suitable material, such as aluminum, and the clamping means and flange portion are attached on opposite sides of the walls 21, 15 and 22 by rivets 31.

At the end of the concave shell 21 opposite the beam 26, a similar frame section 33 is provided and it has a cross section identical with that of the frame section 26 and is attached to the walls 21, 15 and 22 in the same manner as described above in connection with the beam 26. A clamping strip 35 secures the walls 21, 15 and 22 to the flange of the frame section 33 by suitable rivets 37.

The end walls 23 and 24 are not formed by the unitary sheet of which the walls 15, 21 and 22 are separately formed, and each is secured at the respective ends of the lower concave shell 12 to the frame sections 26 and 33, respectively. More particularly, and during assembly, after the frame sections 26 and 33 are fastened in place as described above, the walls 24 and 23 are dropped into place fitting within the channel 27 of the frame section 26 and the corresponding channel in the frame section 33. Rivets 39 are used to secure the walls 24 and 23 in place, passing through both sides of the channel portions of the frame sections, as may be seen clearly in FIG. 3.

To add further rigidity to the construction illustrated in FIGS. 1-3, the upper and outer edge of the lower shell is provided an encircling frame section formed, in this instance, in several pieces, such as frame sections 41 and 43 each of which is coextensive with the outer edges 45 and 47 of the side walls 22 and 21, respectively. These outer edges 45 and 47 define two sides of the opening into the concavity of the shell 12. Each of the frame sections 41 and 43 is of a cross section identical with that of the frame section 26. Thus, the frame section 45 includes a channel portion 49 and a flange portion 51 extending therefrom and forming a continuation of the base of the channel portion. Similarly, the frame section 43 includes a channel portion 53 and a flange portion 55 extending therefrom and forming a continuation of the base of the channel portion 53. Each frame section has its flange portion disposed against the outer side of the respective side walls at the outer edges thereof with the channel portions extending transversely across the outer edges. For each of the frame sections 41 and 43, an elongated clamping member is provided coextensive with the frame sections. In the illustrated embodiment, this comprises a channel 57 for the frame section 41 and a channel 59 for the frame section 43. Channels 57 and 59 are disposed against the inner sides of the walls 22 and 21, respectively, opposite the flange portions 51 and 55, respectively. The channels 57 and 59 are attached to the flanges 51 and 55, respectively, by rivets 61. The combination of the channels and the respective beams mounted as described provides extremely high longitudinal rigidity for the lower concave shell 12.

Completing the structure of the lower concave shell 12 are two transverse frame sections 63 and 65. For purposes of mating and engagement, the frame sections 63 and 65 and the flange sections 41 and 43 are appropriately mitered at their adjoining ends as may be seen in FIG. 1. The frame sections 63 and 65 are of identical cross section with the frame section 26 and are secured to the upper edges of the walls 24 and 23, respectively, in the same manner as that described in connection with the flange sections 41 and 43.

Although the upper concave shell 11 is of somewhat less depth than the lower concave shell 12, the upper concave shell 11 is of substantially identical construction. Thus, the back wall 14 and two side walls 16 and 17 are formed of a single sheet of semi-rigid material, such as ABS plastic bent to form the separate wall. Rigidity is provided by frame sections 67 and 69 which are identical in cross section to the frame section 46 and which are attached to the walls 14, 16 and 17 in the same manner as that described in connection with the frame sections 26 and 33. The side walls 18 and 19 are secured in the channel portions of the frame sections 69 and 67, respectively, in the same manner as that described in connection with the side walls 23 and 24 of the lower concave shell 12. Longitudinal rigidity is provided to the upper concave shell by longitudinal frame sections 71 and 73 in a manner substantially identical to that of the frame sections 41 and 43. Cross frame sections 75 and 77 are also secured in the same manner as the cross frame sections 63 and 65 and mate with the frame sections 71 and 73 at mitered corners, as may be seen in FIG. 1.

Completing the case of FIG. 1 are suitable latches 79 which co-operate with latch hooks 81 mounted on the upper shell 11 to hold the shell in a closed condition. The underside of the back wall 14 of the upper shell 11 is provided with a channel 83 which provides rigidity for supporting a carrying handle, not shown. Carrying handles 85 are provided on the walls 23 and 24 of the lower concave shell 12. Support knobs, not visible, may be provided on the underside of the back wall 15 and secured thereto by suitable rivets 87.

Figure 4:
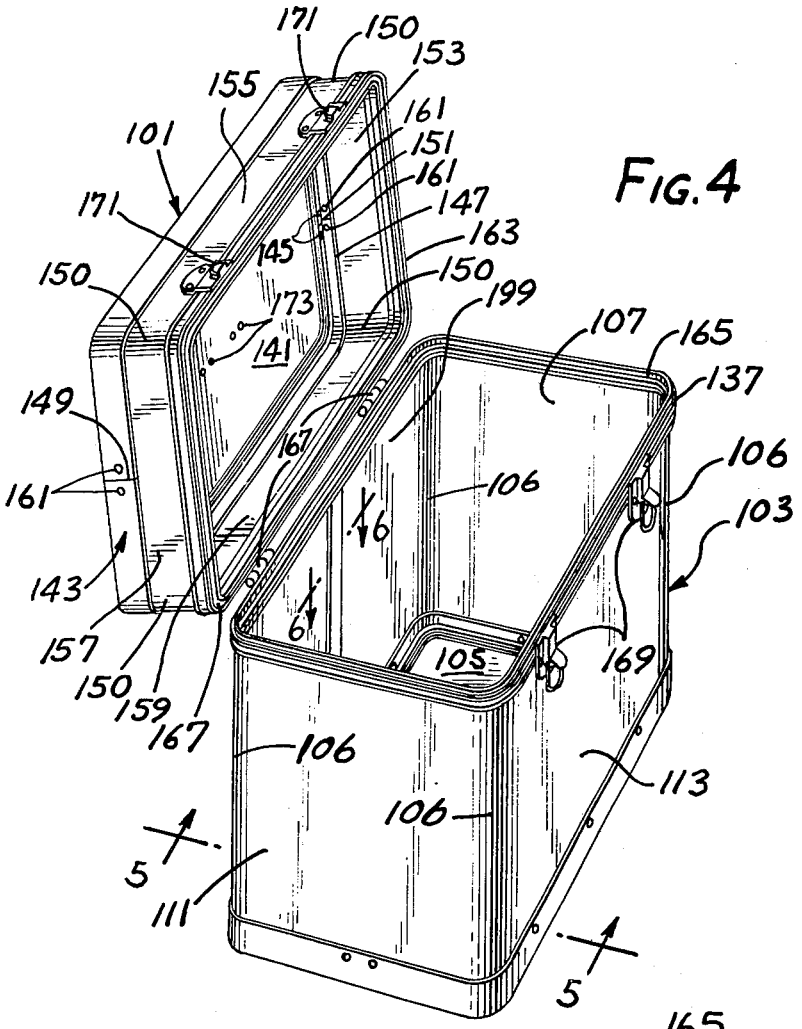
FIG. 4 is a perspective view illustrating an alternative embodiment of the invention in the open condition.
Figure 5:
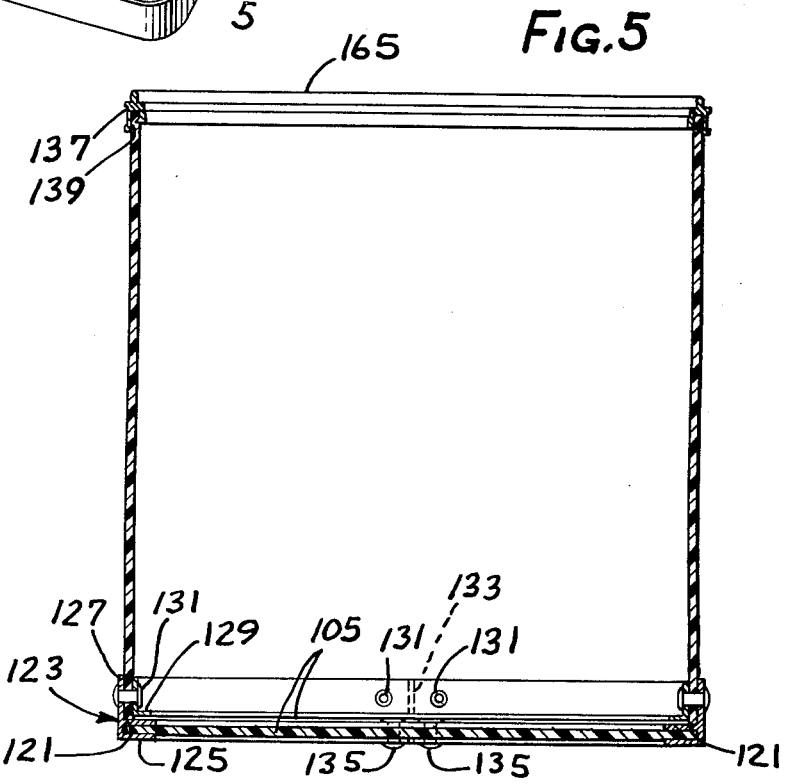
FIG. 5 is a sectional view taken along a plane through the line 5—5 of FIG. 4.
Figure 6:
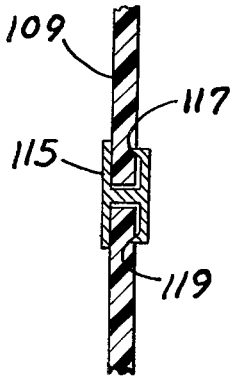
FIG. 6 is a partial sectional view taken along a plane through the line 6—6 of FIG. 4.

Referring now to FIGS. 4 through 6, an alternative embodiment of the invention is shown. The embodiment of FIGS. 4 through 6 is designed to carry relatively heavy objects, but is deeper relative to its length than in the case of the embodiment of FIGS. 1 through 3. In this further embodiment of the invention, a single sheet of material is bent to form four vertical side walls 107, 109, 111 and 113 with a frame section 123 secured to a lower continuous edge of the sheet to add rigidity thereto and to retain the rounded corners 106 between these vertical side walls.

The fabricated case of FIGS. 4 through 6 comprises two opposed concave shells 101 and 103, the latter being substantially deeper than the former. The lower shell 103 includes a back wall 105 and the four side walls 107, 109, 111 and 113. The four side walls 107, 109, 111 and 113 are formed from a single sheet of semi-rigid material such as ABS plastic which is bent with a heated tool to form a generally rectangular outline shell with rounded corners. The semi-rigid material may be of the same type as described in connection with the embodiment of FIGS. 1–3. The sheet is joined back upon itself in the middle of the side wall 109 by a clamping strip 115 having a cross section generally shaped as a capital H. Two inwardly turned projections 117 and 119 (see FIG. 6) are crimped into the sheet forming the side wall 109 to secure the abutting ends of the strip in place against the cross bar of the H-shaped strip 115.

The lower edge of the sheet which forms the four side walls 107, 109, 111 and 113 is a continuous edge lying in the planes of all of the walls formed by the sheet. Preferably, the frame section 123 is coextensive with the continuous edge 121. As was the case with the frame section 26 in the embodiment of FIGS. 1 through 3, the frame section 123 includes a channel portion 125 and an integral flange portion 127 extending therefrom and forming a continuation of the base of the channel portion. The flange portion is disposed against the outer side of the walls 107, 109, 111 and 113 at the continuous edge 121 with the channel portion 125 extending across the continuous edge. The beam thus has the cross section of the shape of a capital F, shown inverted in FIG. 5.

In order to secure the frame section 123 in place, an elongated clamping member is disposed against the inner side of the walls opposite the flange portion 127 of the beam. In the illustrated embodiment, the clamping member comprises a strip of L-shaped cross section and a plurality of rivets 131 are spaced along the length of the beam 123 to attach the strip 129 and the flange portion 127 to the walls therebetween at selected critical points. Where the frame section 123 abuts itself, two of the rivets 131 are spaced closely on opposite sides of the juncture, indicated by line 133.

The back panel 105 comprises a planar sheet of semi-rigid material having its periphery extending into the channel portion 125 of the frame section 123. The panel 105 is secured in place by rivets 135 spaced strategically around the frame section 123 and extending through the sides of the channel 125 and through the panel 105. During assembly, the frame section 123 may first be formed around the panel 105 and riveted thereto. Then the walls 107, 109, 111 and 113 may be formed out of the unitary sheet and secured to the flange 127.

The upper edge of the sheet forming the walls 107, 109, 111 and 113 has a valance 137 surrounding same. The valance 137 provides stiffening as well as a tongue and groove mating configuration for the upper concave shell 101, which is described below. The valance 137 is provided with a recess 139 therein which clamps onto the sheet in a manner similar to the valance described in connection with the case shown and described in U.S. Pat. No. 3,542,171, assigned to the assignee of the present invention.

The upper concave shell 101 of the case of FIGS. 4 through 6 is of substantially less depth than the lower shell 103 but is of substantially identical construction. Thus, the back wall 141 of the upper shell 101 is mounted in the channel of a peripheral frame section 143 having a cross section identical to that of the beam

123. The frame section 143 is attached by rivets 145 extending through it and an interior extensive clamping member 147 of L-shaped cross section. It should be noted that, similar to the case in connection with the lower concave shell 103, the butt region 149 of the frame section 145 is placed on a wall opposite that from the butt region 151 of the clamping member 147. The side walls 153, 155, 157 and 159 of the upper concave shell 101 are formed of a single plastic sheet bent with a heated tool to form rounded corners 150; and these side walls are mounted to the beam 143 in a manner identical with that of the frame section 123.

To provide stiffening about the peripheral edge formed by the walls 153, 155, 157 and 159, a valance 163 is provided clamped to the walls in a manner similar to that of the valance 137 and having a mating configuration with the valance 137. Thus, the valance 137 is provided with a tongue portion 165 whereas the valance 163 is provided with a mating groove portion 167. With the two opposed concave shells 101 and 103 in a closed condition, the valance 163 mates with the valance 137 to securely support the two shells in abutting relationship. To provide for pivoting of the two shells, hinges 167 are mounted thereto. The two opposing concave shells may be secured together by latches 169 mounted to the concave shell 103 and by latch hooks 171 mounted to the concave shell 101. A carrying handle, not shown, is secured to the back wall 141 of the upper concave shell by rivets 173.

The fabricated case described herein allows the forming of a very strong case suitable for carrying relatively heavy objects and in diverse shapes without the necessity of complex molds or the use of excessive material. Cases which are very deep, in contrast to the shallow vacuum molded attache cases, may be formed without the stretching and reduction of wall thickness experienced with molded shell attache or luggage cases. Very little tooling is required to manufacture the case, and the case is readily assembled from a small inventory of frame sections and plastic sheet material. The walls of the case may be made out of a relatively lightweight plastic material while the use of the frame sections as described herein provides the necessary strength and rigidity.

Various modifications of the invention in addition to those shown and described herein will become apparent to those skilled in the art from the foregoing description and accompanying drawings. Such modifications are intended to fall within the scope of the appended claims.

What is claimed is:

1. A case suitable for carrying relatively heavy objects, comprising, two opposed concave shells and means pivotally mounting said shells for movement between a closed position in which said shells enclose a volume to an open position in which the concavities of said shells are exposed, each of said shells including a back wall and four side walls, at least three of said walls in at least one of said shells being a single sheet of semi-rigid material bent to form the separate walls and defining at least two integral corners joining said walls, said sheet having a continuous edge lying in the planes of all of said walls formed thereby, a frame section means substantially coextensive with said continuous edge and having a channel portion and an integral flange portion extending therefrom, said flange portion being disposed against the outer sides of said walls at said continuous edge with said channel portion extending transversely across said continuous edge, an elongated clamping member disposed against the inner side of said walls opposite said flange portion, and means attaching said clamping member and said flange portion to said walls therebetween to add rigidity to said case and to retain said walls in a predetermined relationship to each other.

2. A case according to claim 1 wherein said sheet of semi-rigid material comprises said back wall and two of said side walls.

3. A case according to claim 1 wherein said sheet of semi-rigid material comprises said four side walls.

4. A case according to claim 1 wherein said elongated clamping member comprises a flat strip.

5. A case according to claim 1 wherein said elongated clamping member comprises a strip of L-shaped cross section.

6. A case according to claim 1 wherein said elongated clamping member comprises a channel.

7. A case according to claim 1 wherein a further one of said walls comprises a planar sheet of semi-rigid material having its periphery extending into said channel portion of said frame section.

8. A case according to claim 1 wherein said sheet of semi-rigid material comprises said back wall and two of said side walls, said side walls having substantially parallel outer edges defining two opposite sides of the opening into the concavity of said shell, wherein a further pair of frame sections are provided coextensive with said outer edges, respectively, said further pair of frame sections each having a channel portion and an integral flange portion extending therefrom and forming a continuation of said channel portion, said flange portions being disposed against the outer sides of said walls at said outer edges thereof with said channel portions extending transversely across said outer edges, and wherein an elongated clamping member is provided coextensive with each of said frame sections, said clamping members being disposed against the inner side of said walls opposite said flange portions, and means attaching said clamping members and said flange portions to said walls therebetween.

9. A case suitable for carrying relatively heavy elongated objects, comprising, two opposed concave shells and means pivotally mounting said shells for movement between a closed position in which said shells enclose a volume to an open position in which the concavities of said shells are exposed, at least one of said shells having a substantial depth and comprising a single plastic sheet bent to form a back wall and two side walls, integral rounded corners formed in said sheet to join said back to said side walls, said sheet being of a shape such that when so bent there is formed an elongated trough of U-shaped cross section, said sheet having first and second continuous edges at opposite ends of said trough formed thereby lying in the planes of all of said walls formed thereby, a first frame section coextensive with said first continuous edge, a second frame section coextensive with said second continuous edge, said first and second frame sections each having a channel portion and an integral flange portion extending therefrom and forming a continuation of the base of said channel portion, said flange portions being disposed against the outer sides of said walls at said continuous edges, respectively, with said channel portions extending transversely across said continuous edges, a pair of elongated clamping members for cooperation with said first and second frame sections and being disposed against the inner side of said walls opposite said flange portions, said sheet having two substantially parallel outer edges defining two sides of the opening into the concavity of said shell, third and fourth frame sections coextensive with said outer edges, respectively, said third and fourth frame sections each having a channel portion and an integral flange portion extending therefrom and forming a continuation of the base of said channel portion, said flange portions being disposed against the outer sides of said walls at said outer edges thereof, respectively, with said channel portions extending transversely across said outer edges, an elongated clamping member coextensive with each of said third and fourth frame sections and being disposed against the inner side of said walls opposite said flange portions, and means attaching said clamping members and said flange portions of said frame sections to said walls therebetween.

10. A case according to claim 9 having two additional side walls each comprising a planar sheet of semirigid material having its periphery extending into said channel portions of a respective one of said first and second frame sections.

11. A case suitable for carrying relatively heavy objects, comprising, two opposed concave shells and means pivotally mounting said shells for movement between a closed position in which said shells enclose a volume to an open position in which the concavities of said shells are exposed, at least one of said shells including a back wall and four side walls, said side walls being formed of a single plastic sheet bent to form the separate walls, integral rounded corners formed by bending said sheet and joining adjacent side walls, said sheet having a continuous edge lying in the plane of all of said walls formed thereby, a frame section coextensive with said continuous edge, said frame section having a channel portion and an integral flange portion extending therefrom and forming a continuation of the base of said channel portions, said flange portion being disposed against the outer sides of said walls at said continuous edge with said channel portions extending transversely across said continuous edge, an elongated clamping member being disposed against the inner side of said walls opposite said flange portion, and means attaching said clamping member and said flange portion to said walls therebetween, said back wall having its periphery extending into said channel portion of said flange section.

* * * * *